US007815419B2

(12) United States Patent
Teraoka et al.

(10) Patent No.: US 7,815,419 B2
(45) Date of Patent: Oct. 19, 2010

(54) IMPELLER FOR BLOWER AND AIR CONDITIONER HAVING THE SAME

(75) Inventors: Hironobu Teraoka, Sakai (JP); Hirohiko Matsushita, Sakai (JP); Tadashi Ohnishi, Sakai (JP); Hideshi Tanaka, Kusatsu (JP); Kouzou Yoshinaga, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 469 days.

(21) Appl. No.: 10/588,802

(22) PCT Filed: Sep. 30, 2005

(86) PCT No.: PCT/JP2005/018129

§ 371 (c)(1),
(2), (4) Date: Aug. 9, 2006

(87) PCT Pub. No.: WO2006/035933

PCT Pub. Date: Apr. 6, 2006

(65) Prior Publication Data

US 2007/0177971 A1 Aug. 2, 2007

(30) Foreign Application Priority Data

Sep. 30, 2004 (JP) ..... 2004-286760
Sep. 16, 2005 (JP) ..... 2005-269765

(51) Int. Cl.
*F04D 5/00* (2006.01)

(52) U.S. Cl. ..... 416/178; 416/187; 416/231 B; 416/228

(58) Field of Classification Search ..... 415/53.1, 415/53.3, 59.1; 416/178, 187, 203, 231 B, 416/236 R, 228
See application file for complete search history.

(56) References Cited

U.S. PATENT DOCUMENTS 4,089,618 A * 5/1978 Patel ..... 416/228
2003/0175121 A1 * 9/2003 Shibata et al. ..... 416/131

FOREIGN PATENT DOCUMENTS

JP 01167494 A * 7/1989
JP 3-249400 A 11/1991
JP 9-327156 A 12/1997
JP 10-252689 A 9/1998
JP 11-141494 A 5/1999

* cited by examiner

*Primary Examiner*—Edward Look
*Assistant Examiner*—Dwayne J White
(74) *Attorney, Agent, or Firm*—Birch, Stewart, Kolasch & Birch, LLP.

(57) ABSTRACT

An impeller is provided for a blower having a blade (15), a plurality of notches (17) provided at predetermined intervals on a side edge of the blade (15), and a plurality of smooth portions (18) each provided between a pair of the notches (17). Since a transverse vortex discharged from the side edge of the blade (15), and on a large scale, is organized by vertical vortexes formed in the notches (17) on a small scale so as to be segmented into stable transverse vortexes, it becomes possible to reduce aerodynamic noise.

11 Claims, 16 Drawing Sheets

IMPELLER FOR BLOWER AND AIR CONDITIONER HAVING THE SAME

TECHNICAL FIELD

The present invention relates to an impeller for a blower such as a cross flow fan, a sirocco fan, a turbo fan, or a propeller fan, and an air conditioner in which such equipment is installed.

BACKGROUND ART

For example, in an impeller for a blower such as a cross flow fan, a sirocco fan, a turbo fan or a propeller fan, a problem arises in that aerodynamic noise is produced by an air flow passing through a blade constituting the impeller. Among the principal causes of aerodynamic noise produced, is the peeling of air flow on a negative pressure surface of the blade and a trailing vortex produced on a trailing edge of the blade.

In order to reduce the level of aerodynamic noise, a technique has been already proposed which, by means of the formation in a saw-tooth shape of at least one side edge of a pair of side edges in each of the blades constituting the impeller, prevents air flow from peeling on the negative pressure surface of the blade and reduces the occurrence of a trailing vortex on the trailing edge side of the blade (refer to Japanese Laid-Open Patent Publication No. 11-141494).

However, in the case of the technique disclosed in the Japanese Laid-Open Patent Publication No. 11-141494 mentioned above, since the side edge of each of the blades is formed in a saw-tooth shape, the trailing vortex produced on the trailing edge of each of the blades is excessively segmented into a plurality of unstable vortexes. Accordingly, these segmented vortexes interfere with adjacent vortexes, and cases occur where significant reductions in the level of aerodynamic noise can not be obtained. Further, processes for forming the side edge of the blade in a saw-tooth shape are far from simple, and another problem that arises is that it is hard to form a side edge of a blade in a saw-tooth shape in cases where the blade is small.

DISCLOSURE OF THE INVENTION

Problem to be Solved by the Invention

The present invention has been achieved by taking into consideration the points described above, and an object of the present invention is to provide an impeller for a blower which, by virtue of being of a simpler shape, can effectively reduce the level of aerodynamic noise, and an air conditioner in which such equipment is provided.

Means for Solving the Problems

In accordance with the present invention, as a first aspect for solving the problem mentioned above, an impeller for a blower is provided comprising: a blade 15; a plurality of notches 17 provided at predetermined intervals on a side edge of the blade 15; and a plurality of smooth portions 18, each being provided between a pair of the notches 17.

In accordance with the structure mentioned above, since a transverse vortex discharged from the side edge of the blade 15, and on a large scale, is organized by vertical vortexes formed in the notches 17 on a small scale so as to be segmented into stable transverse vortexes, it is possible to reduce aerodynamic noise. Further, since it is possible to reduce the number of notches 17 per unit length due to the smooth portions 18 each provided between an adjacent pair of the notches 17, the notches 17 can be more easily formed than in the case of the saw tooth shape mentioned above.

In accordance with the present invention, as a second aspect for solving the problem mentioned above, an impeller is provided for a blower comprising: a circular support plate 14 having a rotational axis; and a plurality of blades 15 provided at a peripheral edge portion of the support plate 14, extending in parallel to the rotational axis and having a predetermined blade angle. A plurality of notches 17 are provided at an outer edge 15*a* of a pair of side edges of each of the blades 15, and the respective notches 17 are arranged at predetermined intervals along a longitudinal direction of the respective blades 15. A smooth portion 18 is provided between each pair of the notches 17.

In accordance with the structure mentioned above, in cases where the impeller for the blower is provided in the form of a sirocco fan, at the trailing edge of each blade 15, the transverse vortex discharged from the outer edge 15*a* of the blade 15, and on a large scale, is segmented into stable transverse vortexes organized at the small scale by the vertical vortexes formed in the notches 17. Accordingly, it is possible to reduce aerodynamic noise. Further, in cases where the impeller for the blower is provided in the form of a cross flow fan, in a suction region of the cross flow fan, on the basis of the vertical vortexes formed by the notches 17 at a front edge side of the blade 15 it is possible to reduce aerodynamic noise by suppressing the peeling of the air flow on the negative pressure surface side of the blade 15. Further, since a similar operation to that of the sirocco fan mentioned above can be performed in a blowout region of the cross flow fan, it is possible to reduce aerodynamic noise. In addition, for the same reasons as mentioned above notches 17 can be more easily formed than in the case of the saw tooth shape mentioned above.

In accordance with the present invention, as a third aspect for solving the problem mentioned above, an impeller is provided for a blower comprising: a circular support plate 14 having a rotational axis; and a plurality of blades 15 provided on a peripheral edge portion of the support plate 14, extending in parallel to the rotational axis and having a predetermined blade angle. A plurality of notches 17 are provided on an inner edge 15*b* of a pair of side edges of each of the blades 15, and the respective notches 17 are arranged at predetermined intervals along a longitudinal direction of the respective blades 15. A smooth portion 18 is provided between each pair of the notches 17.

In accordance with the structure mentioned above, in cases where the impeller for the blower is provided in the form of a sirocco fan, on the basis of vertical vortexes formed by the notches 17 on the front edge side of the blade 15 it is possible to reduce aerodynamic noise by suppressing peeling of the air flow from the negative pressure surface side of the blade 15. Further, in cases where the impeller for the blower mentioned above is provided as a cross flow fan, in the suction region of the cross flow fan, on the trailing edge side of the blade 15, the transverse vortex discharged from the inner edge 15*b* of the blade 15, and of a large scale, is segmented into stable transverse vortexes organized on a small scale by the vertical vortexes formed in the notches 17. Accordingly, it is possible to reduce aerodynamic noise. Further, since similar operation to that in the case of the sirocco fan mentioned above can be obtained in the blowout region of the cross flow fan, it is possible to reduce aerodynamic noise. In addition, for the same reasons as mentioned above notches 17 can be more easily formed than in the case of the saw tooth shape mentioned above.

In accordance with the present invention, as a fourth aspect for solving the problem mentioned above, an impeller is provided for a blower comprising: a circular support plate 14 having a rotational axis; and a plurality of blades 15 provided on a peripheral edge portion of the support plate 14, extending in parallel to the rotational axis and having a predetermined blade angle. A plurality of notches 17 are provided at both side edges 15*a* and 15*b* of each of the blades 15, and the respective notches 17 are arranged at predetermined intervals along a longitudinal direction of the respective blades 15. A smooth portion 18 is provided between each pair of the notches 17.

In accordance with the structure mentioned above, in cases where the impeller for the blower is provided as a sirocco fan, on the basis of the vertical vortexes formed by the notches 17 on the front edge side of the blade 15 it is possible to reduce aerodynamic noise by suppressing the peeling of the air flow on the negative pressure surface side of the blade 15. Further, on the trailing edge side of the blade 15, since the transverse vortex discharged from the side edges 15*a* and 15*b* of the blade 15, and on a large scale, is segmented into stable transverse vortexes organized on a small scale by the vertical vortexes formed in the notches 17, it is possible to reduce aerodynamic noise. Further, in cases where the impeller for the blower mentioned above is provided in the form of a cross flow fan, a similar operation to that of the sirocco fan can be obtained in the suction region and the blowout region of the cross flow fan. Accordingly, it is possible to reduce aerodynamic noise. In addition, for the same reasons as mentioned above the notches 17 can be formed more easily than in the case of the saw tooth shape mentioned above.

In accordance with the present invention, as a fifth aspect for solving the problem mentioned above, an impeller is provided for a blower comprising: a circular support plate 14 having a rotational axis; and a plurality of blades 15 provided on a peripheral edge portion of the support plate 14, extending in parallel to the rotational axis and having a predetermined blade angle. A plurality of notches 17 are provided on an outer edge 15*a* of a pair of side edges of a predetermined blade 15 selected from a plurality of blades 15, and the respective notches 17 are arranged at predetermined intervals along a longitudinal direction of the predetermined blade 15. A smooth portion 18 is provided between each pair of the notches 17.

In accordance with the structure described above, in cases where the impeller for the blower is provided in the form of a sirocco fan, on the trailing edge side of the blade 15, since the transverse vortex discharged from the outer edge 15*a* of the blade 15, and on a large scale, is segmented into stable transverse vortexes organized on a small scale by the vertical vortexes formed in the notches 17, it is possible to reduce aerodynamic noise. Further, in case where the impeller for the blower mentioned above is provided in the form of a cross flow fan, on the basis of the vertical vortexes formed by the notches 17 on the front edge side of the blade 15, in the suction region of the cross flow fan it is possible to reduce aerodynamic noise by suppressing the peeling of the air flow on the negative pressure surface side of the blade 15. Further, since a similar operation to that of the sirocco fan can be obtained in the blowout region of the cross flow fan, it is possible to reduce aerodynamic noise. In addition, the notches 17 can be more easily formed than in the case of the saw tooth shape mentioned above, for the same reasons as mentioned above. Furthermore, since the blade 15X, in which notches 17 are formed, and the blade 15Y, in which notches 17 are not formed, exist together, at a time of sucking or blowing out the air it is possible to prevent air from leaking from a gap between a member (for example, a casing) surrounding the impeller and the impeller itself, and it is thus possible to enhance a blowing performance of the blower. Further, by virtue of the existence of the blade 15Y in which the notches 17 are not formed it is possible to reinforce the strength of the impeller.

In accordance with the present invention, as a sixth aspect for solving the problem mentioned above, an impeller is provided for a blower comprising: a circular support plate 14 having a rotational axis; and a plurality of blades 15 provided at a peripheral edge portion of the support plate 14, extending in parallel to the rotational axis and having a predetermined blade angle. A plurality of notches 17 are provided on an inner edge 15*b* of a pair of side edges of a predetermined blade 15 selected from among a plurality of blades 15, and the respective notches 17 are arranged at predetermined intervals along a longitudinal direction of the predetermined blade 15. A smooth portion 18 is provided between each pair of the notches 17.

In accordance with the structure mentioned above, in cases where the impeller for the blower is provided as a sirocco fan, on the basis of the vertical vortexes formed by the notches 17 on the leading edge side of the blade 15 it is possible to reduce aerodynamic noise by suppressing the peeling of the air flow on the negative pressure surface side of the blade 15. Further, in cases where the impeller for the blower described above is provided in the form of a cross flow fan, in the suction region of the cross flow fan, on the trailing edge side of the blade 15, since the transverse vortex discharged from the inner edge 15*b* of the blade 15, and on a large scale, is segmented into stable transverse vortexes organized on a small scale by the vertical vortexes formed in the notches 17, it is possible to reduce aerodynamic noise. Further, in the blowout region of the cross flow fan, since a similar operation to that of the sirocco fan can be obtained on the front edge side of the blade 15, it is possible to reduce aerodynamic noise. In addition, for the same reasons as mentioned above the notches 17 can be more easily formed than in the case of the saw tooth shape mentioned above. Since the blade 15X, in which the notches 17 are formed, and the blade 15Y, in which the notches 17 are not formed, exist together, it is possible to reduce aerodynamic noise on the basis of the effects of the notches 17 while at the same time retaining the strength that is necessary for the impeller.

In accordance with the present invention, as a seventh aspect for solving the problem mentioned above, an impeller is provided for a blower comprising: a circular support plate 14 having a rotational axis; and a plurality of blades 15 provided on a peripheral edge portion of the support plate 14, extending in parallel to the rotational axis and having a predetermined blade angle. A plurality of notches 17 are provided on both side edges 15*a* and 15*b* of a predetermined blade 15, selected from among a plurality of blades 15, and the respective notches 17 are arranged at predetermined intervals along a longitudinal direction of the predetermined blade 15. A smooth portion 18 is provided between each pair of the notches 17.

In accordance with the structure mentioned above, in cases where the impeller for the blower is provided in the form of a sirocco fan, on the basis of the vertical vortexes formed by the notches 17 on the front edge side of the blade 15 it is possible to reduce aerodynamic noise by suppressing peeling of the air flow on the negative pressure surface side of the blade 15. Further, on the trailing edge side of the blade 15, since the transverse vortex discharged from the side edges 15*a* and 15*b* of the blade 15, and on a large scale, is segmented into stable transverse vortexes organized on a small scale by the vertical vortexes formed in a notches 17, it is possible to reduce aerodynamic noise. Further, in cases where the impeller for the blower mentioned above is provided in the form of a cross flow fan, since a similar operation to that of the sirocco fan can be obtained in the suction region and the blowout region of the cross flow fan, it is possible to reduce aerodynamic noise. In addition, for the same reasons as mentioned above the notches 17 can be more easily formed than in the case of the saw tooth shape mentioned above. Moreover, since the blade 15X, in which notches 17 are formed, and the blade 17Y, in which notches 17 are not formed, exist together, on the basis of the effects of the notches 17 it is possible to reduce aerodynamic noise while at the same time retaining the strength required by the impeller. Further, a gap between the member (for example, the casing) surrounding the impeller and the impeller itself becomes wider by notches 17 formed on the outer edge 15*a* of the blade 15X, and it is possible to enhance the blowing performance of the blower by preventing increases in the degree of leaking of air flow from the gap.

In accordance with the present invention, as an eighth aspect for solving the problem mentioned above, an impeller is provided for a blower comprising: a plurality of impellers continuously provided on the same rotational axis. Impellers positioned at both ends of the blower in a plurality of impellers are structured by the impeller 7Z for the blower described in any one of the fifth to seventh aspects mentioned above, and other impellers are structured by the impeller 7 for the blower described in any one of the second to fourth aspects.

In accordance with the structure mentioned above, at both ends considered as starting points of unstable behavior of a blowout flow at a time of a rotational destruction and a high pressure loss, on the basis of the suppression to a maximum limit of production of trailing vortex it is possible to maintain the necessary strength of the impeller while at the same time limiting to a minimum degree reductions in blow noise. Further, in cases where the notches 17 are formed on the outer edge 15*a* of the blade 15, it is possible to prevent a reflow vortex that has been formed within the impeller from being increased, and at both ends of the impeller it is possible to make it difficult for unstable behavior to occur at a time of the high pressure loss. The reflow vortex is formed by an increase in leakages of air flow from the gap between the impeller at the position where the notches 17 are formed on the blade 15X, and a member provided so as to face the impeller (for example, a tongue portion 11 preventing a back flow of air flow blowing out of the impeller).

In accordance with the present invention, as a ninth aspect for solving the problem mentioned above, an air conditioner is provided comprising: the impeller for the blower as recited in any one of the second to eighth aspects described above. In accordance with this structure, it is possible to obtain a low noise type of air conditioner.

In accordance with the present invention, as a tenth aspect for solving the problem mentioned above, an air conditioner is provided comprising: the impeller 7 for the blower as recited in any one of the second, fourth, fifth, seventh and eighth aspects mentioned above; and a casing 1 that has a tongue portion 11 and that surrounds the impeller 7. The tongue portion 11 prevents a back flow of air flow blown out from the impeller 7. A plurality of notches 17 having the same shape are formed coaxially on an outer edge 15*a* of each of the blades 15. A plurality of projections 19 are provided in the tongue portion 11, and the respective projections 19 correspond to the respective notches 17 provided on the outer edge 15*a*.

In accordance with the structure mentioned above, it is possible to enhance blowing performance of the blower by preventing the gap between the tongue portion 11 and the impeller 7 from expanding at positions where notches 17 are formed, by projections 19, and by preventing the air flow from leaking via the gap.

In accordance with the present invention, as an eleventh aspect for solving the problem mentioned above, an air conditioner is provided comprising: the impeller 7 for the blower as recited in any one of the second, fourth, fifth, seventh and eighth aspects mentioned above; and a casing 1 that surrounds the impeller 7 and that has a guide portion 10 guiding an air flow blowing out of the impeller 7. A plurality of notches 17 having the same shape are formed coaxially on an outer edge 15*a* of each of the blades 15. A plurality of projections 20 are provided on the guide portion 10, and the respective projections 20 correspond to the respective notches 17 provided in the outer edge 15*a*.

In accordance with the structure mentioned above, it is possible to enhance the blowing performance of the blower by preventing gaps between the guide portion 10 and the impeller 7 from being expanded at positions where the notches 17 are formed, by projections 20, and by preventing the air flow from leaking via the gap.

BEST MODE FOR CARRYING OUT THE INVENTION

Figure 1:
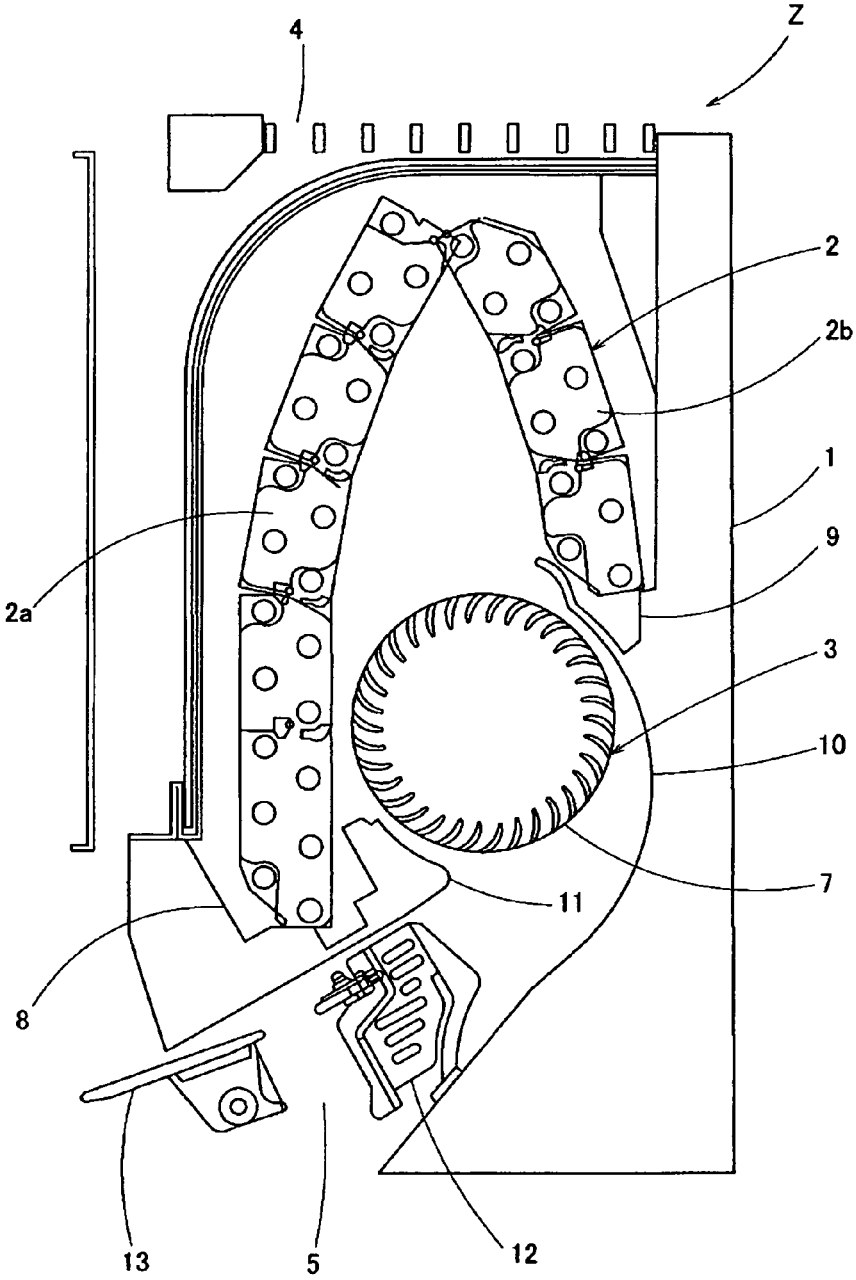
FIG. 1 is a cross sectional view of an air conditioner in accordance with each of embodiments of the present invention.

A description will be given below, with reference to the accompanying drawings, of several preferable embodiments in accordance with the present inventions.

First, with reference to FIG. 1 a description will be given of an air conditioner provided with a blower in accordance with each of the following embodiments.

The air conditioner Z is provided with a box-shaped casing 1, a heat exchanger 2 arranged within the casing 1, and a multi-blade blower 3 arranged on a secondary side of the heat exchanger 2, and is structured as a wall mounted type. An air suction port 4 is formed on an upper surface of the casing 1, and an air blowout port 5 is formed on a front side (the left side in FIG. 1) on a lower surface of the casing 1.

The heat exchanger 2 is configured by a front face heat exchanging portion 2*a* positioned on a front face side of the casing 1, and by a back face heat exchanging portion 2*b* positioned at a back face side of the casing 1. The front face heat exchanging portion 2*a* and the back face heat exchanging portion 2*b* are coupled to each other at their upper end portions. An air flow W is supplied from the air suction port 4 to the front face heat exchanging portion 2*a* via an air passage 6 formed at the front face side of the casing 1.

As the blower 3, a cross flow fan is employed that is provided with an impeller 7 rotationally driven by a drive source (not shown). Accordingly, in the following description, this blower is described as the cross flow fan.

As shown in FIG. 1, a first drain pan 8 receives a drain from the front face heat exchanging portion 2*a*. A second drain pan 9 receives a drain from the back face heat exchanging portion 2*b*. A guide portion 10 guides the air flow W blowing out of the impeller 7. A tongue portion 11 prevents a back flow of air flow W blowing out of the impeller 7. A vertical blade 12 and a horizontal blade 13 are arranged at the air blowout port 5.

The air flow W sucked into the air conditioner Z from the air suction port 4 passes through the heat exchanger 2. At this time, the air is cooled or heated by the heat exchanger 2. Further, the air flows through the cross flow fan 3 so as to be orthogonal to a rotational axis of the cross flow fan 3, and is thereafter blows out of the air blowout port 5 into a room.

FIGS. 2 to 5 show the impeller 7 of the cross flow fan in accordance with a first embodiment of the present invention.

Figure 2:
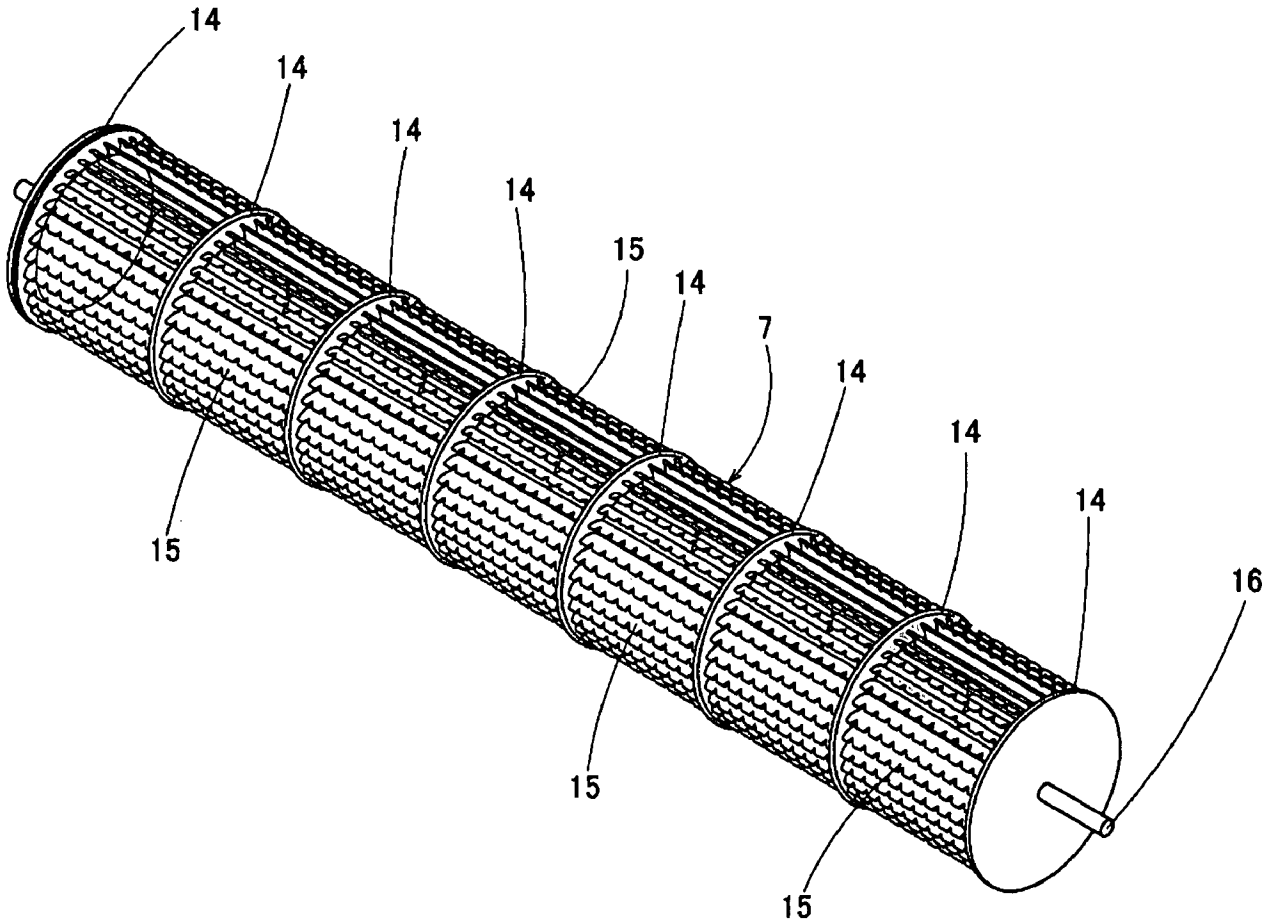
FIG. 2 is a perspective view of an impeller in accordance with a first embodiment.
Figure 3:
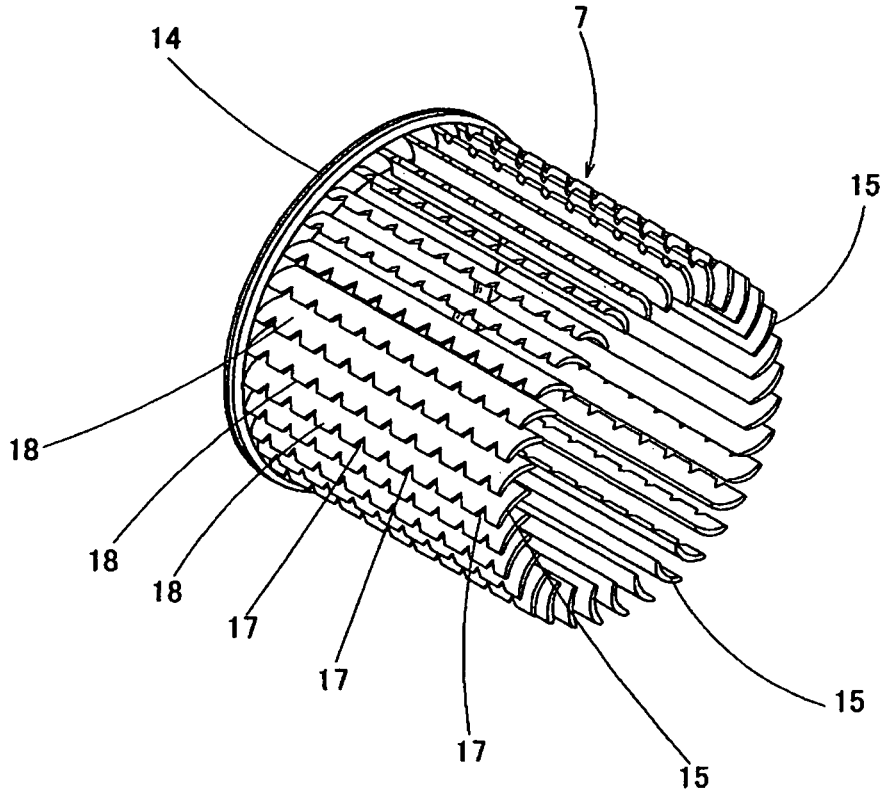
FIG. 3 is a perspective view illustrating a main portion of the impeller in accordance with the first embodiment.

As shown in FIGS. 2 and 3, the impeller 7 of the cross flow fan 3 is provided with a plurality of circular support plates 14 arranged on the same rotational axis in a line at predetermined intervals, a plurality of blades 15 arranged between a pair of adjacent support plates 14, and a pair of rotational shafts 16 arranged on the rotational axis. The support plates 14 arranged in a line are parallel to each other. Each of the rotational shafts 16 is attached to an outer surface of each of the support plates 14 positioned at both ends. The respective blades 15 are arranged between peripheral edge portions of the respective support plates 14 at predetermined angular intervals, and both end portions of each of the blades 15 are fixed to the peripheral edge portions of each of the support plates 14. Each of the blades 15 extends in parallel to the rotational axis of each of the support plates 14, and the impeller 7 has a predetermined blade angle for forming a forward blade structure.

Figure 4:
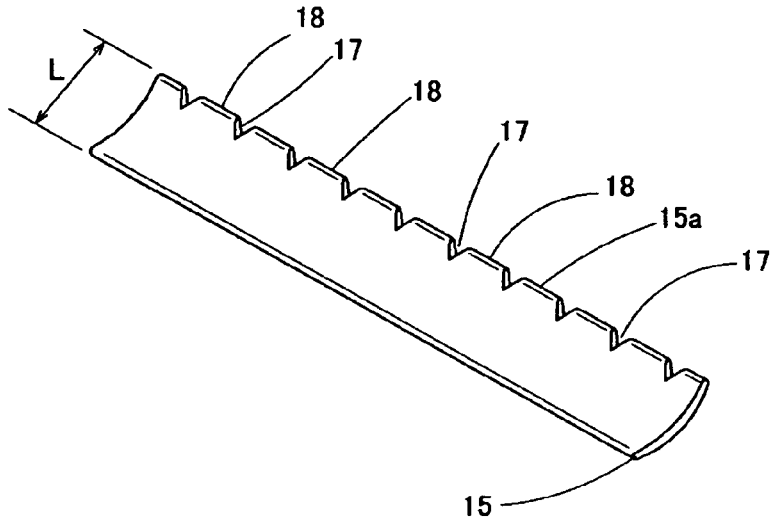
FIG. 4 is a perspective view illustrating an enlargement of a blade in accordance with the first embodiment.
Figures 6A, 6B:
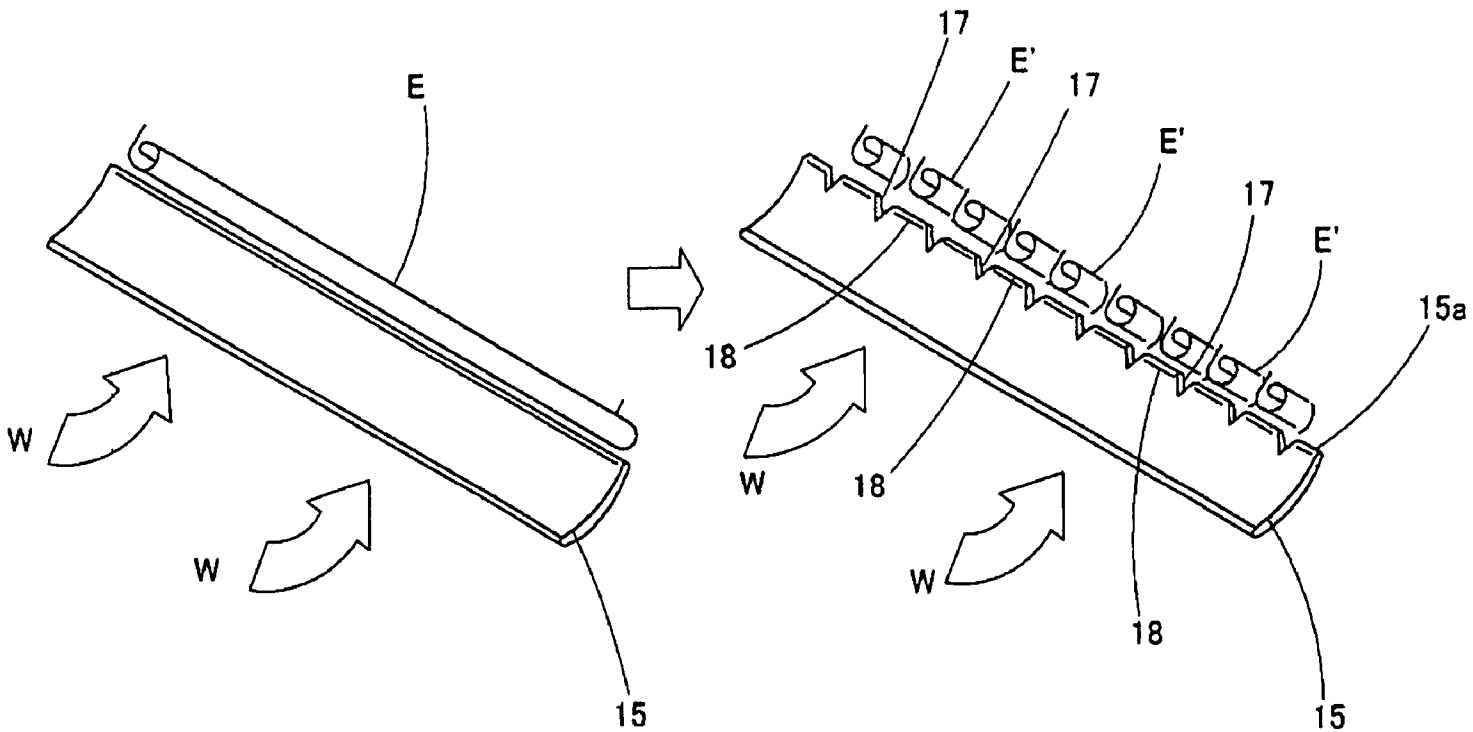
FIG. 6(*a*) is a perspective view illustrating a blade and an air flow in accordance with prior art, FIG. 6(*b*) is a perspective view illustrating the blade and an air flow in accordance with the first embodiment.

As shown in FIG. 4, a plurality of regular triangular notches 17 are intermittently formed on an outer edge 15*a* of a pair of side edges of each of the blades 15 at predetermined intervals along a longitudinal direction of the blade 15. Smooth portions 18 formed along the outer edge 15*a* are arranged between the respective notches 17. In such circumstances, on the basis of the vertical vortex formed by the notches 17 on a leading edge side (the outer edge 15*a* side) of the blade 15, in a suction region of the cross flow fan 3, it is possible to reduce aerodynamic noise by suppressing the peeling of the air flow on the negative pressure surface side of the blade 15. Further, in a blowout region of the cross flow fan 3, on the trailing edge side (the outer edge 15*a* side) of the blade 15, since the transverse vortex discharged from the outer edge 15*a* of the blade 15, and on a large scale, is segmented into stable transverse vortexes organized on a small scale, by the vertical vortex formed at the notches 17 it is possible to reduce aerodynamic noise. In addition, since as a consequence of the smooth portions 18 each provided between an adjacent pair of the notches 17, it is possible to reduce the number of notches 17 per unit length the notches 17 can be more easily formed than in the case of the saw tooth shape mentioned above. Further, since each of the smooth portions 18 constitutes a part of the outer edges 15*a*, it is possible to form notches 17 while maintaining the shape of the outer edge 15*a* of the blade 15. Further, since the shape of each of the notches 17 is formed as a regular triangular shape, it is possible to minimize areas notched by each of the notches 17 on a surface of each of the blades 15, and it is possible to secure to a maximum degree a pressure area for each of the blades 15, that is, an area of a surface receiving the pressure of the air flow on each of the blades 15. As shown in FIG. 6(*a*), in the conventional blade 15 in which the notch is omitted, a transverse vortex E on a large scale is discharged from the outer edge of the blade 15. On the contrary, in the blade 15 in accordance with the present embodiment, as shown in FIG. 6(*b*), a transverse vortex E' segmented by notches 17, that is, a stable transverse vortex E' organized on a small scale, is discharged from the outer edge 15*a* of the blade 15. As a result, the appearance of a trailing vortex on the trailing edge of the blade 15 is suppressed.

Figure 5:
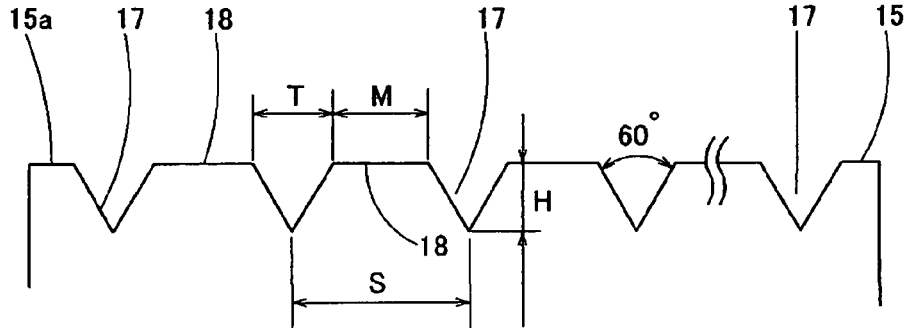
FIG. 5 is a front elevational view illustrating an enlargement of a main portion in accordance with the first embodiment.
Figure 7:
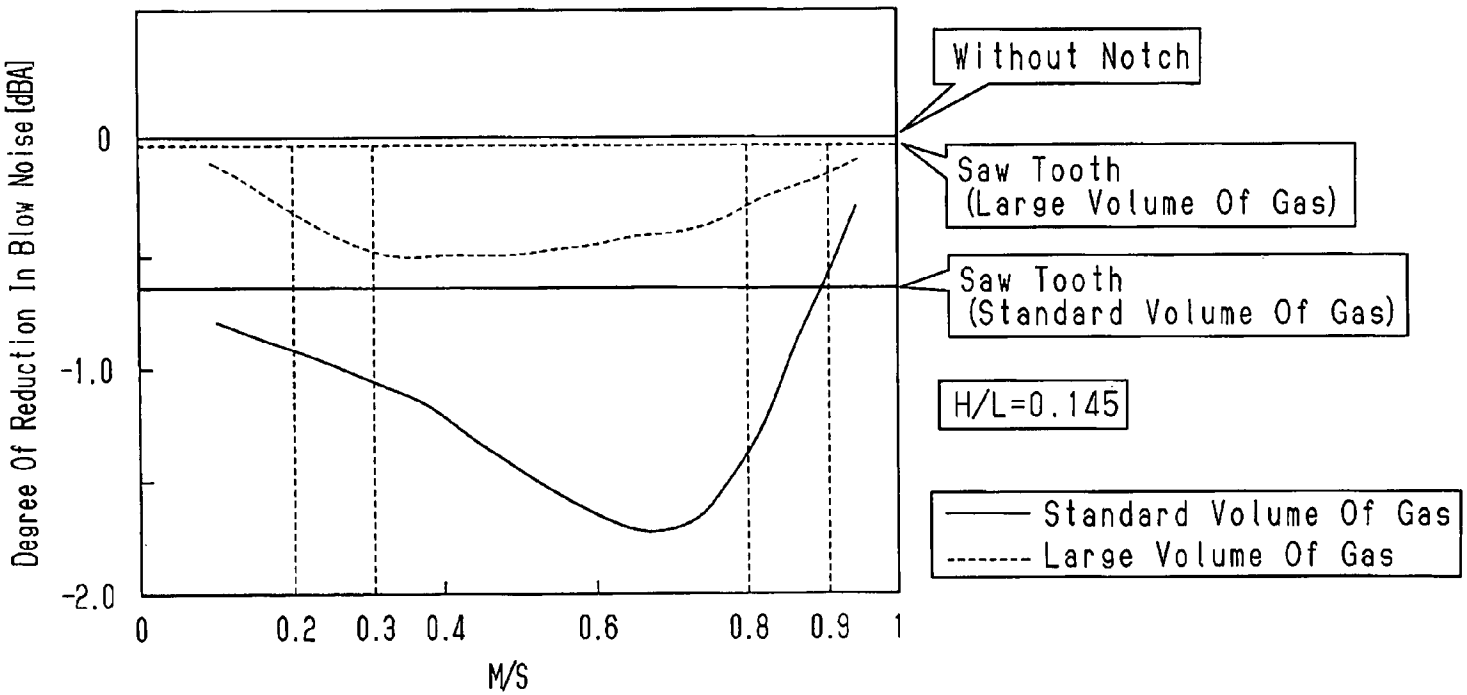
FIG. 7 is a characteristic view illustrating changes in the degrees of reduction of blow noise relating to a rate M/S of a length M of a smooth portion to a pitch S of a notch in the blade in accordance with the first embodiment.

As shown in FIGS. 4 and 5, the pitch of the notches 17 is denoted as S, the length of each of the smooth portions 18 (in other words, the remaining margin of the blade 15 on the outer edge 15*a*) is denoted as M, the depth of each of the notches 17 is denoted as H, the chord length of the blade 15 is denoted as L, and the opening dimension of each of the notches 17 is denoted as T. Further, the degree of reduction in blow noise is measured in relation to the rate M/S of the length M of the smooth portions 18 to the pitch S of the notches 17, and the rate H/L of the depth H of the notches 17 to the chord length L of the blade 15. FIG. 7 illustrates changes in the degree of reduction in blow noise (dBA) relative to the rate M/S in cases where the rate H/L is 0.145, and FIG. 8 illustrates changes in the degree of reduction the blow noise (dBA) relative to the rate H/L in cases where the rate M/S is 0.333.

Figure 8:
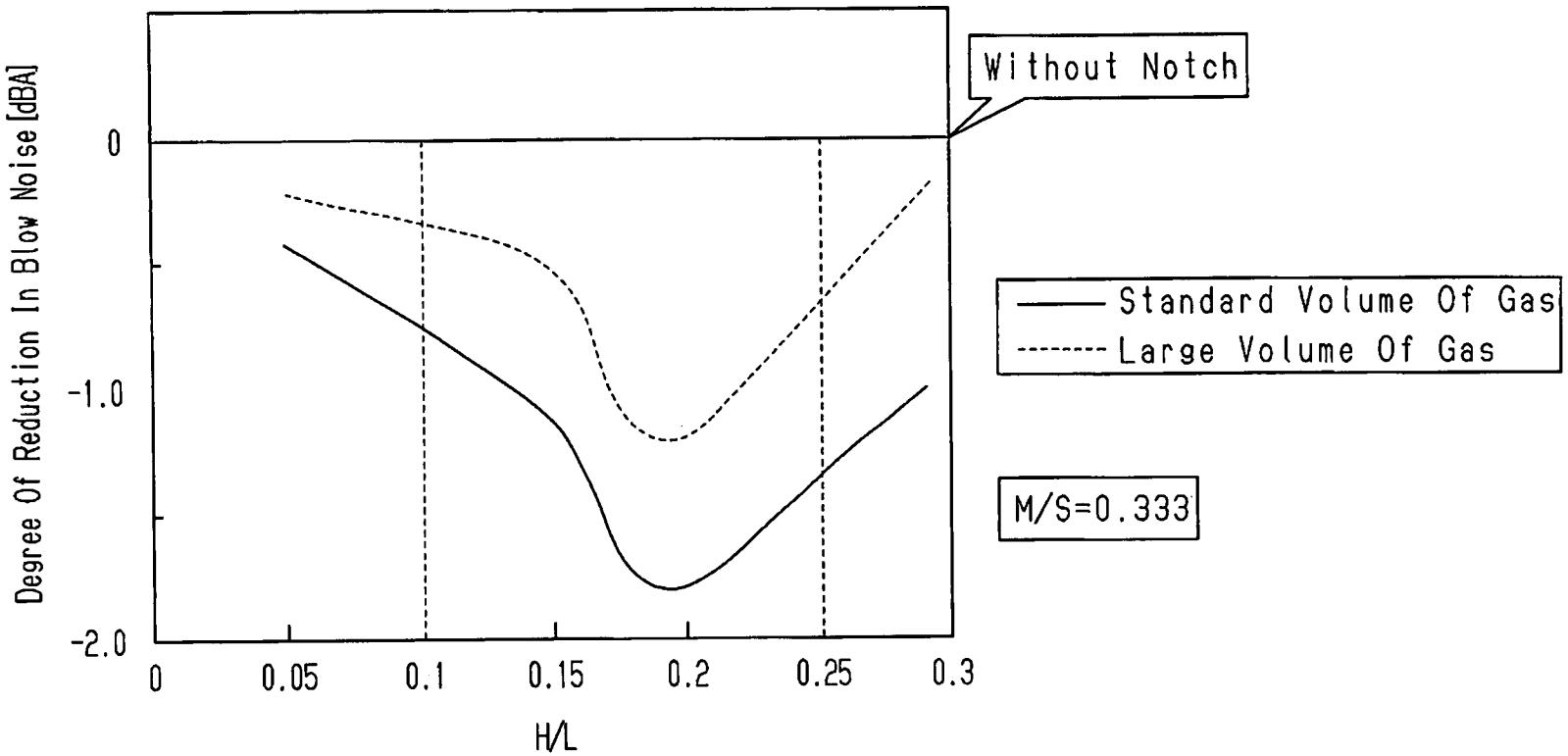
FIG. 8 is a characteristic view illustrating changes in degrees of reduction a blow noise relating to a rate H/L of a depth H of the notch to a chord length L of the blade in the blade in accordance with the first embodiment.

As illustrated in FIGS. 7 and 8, it is preferable that the rate M/S be set to $0.2<M/S<0.9$ regardless of the flow rate of the air flow, and it is preferable that it be set to $0.3<M/S<0.8$ in the event of a large volume of gas (for example, 11.5 $m^3$/min) entailing significant blow noise. Since the rate M/S is set to $0.2<M/S<0.9$, it is possible to reduce significantly the level of blow noise in comparison with a conventional impeller that has no notches 17, and with the impeller that has the saw teeth, as described in the patent document 1. Further, since the rate M/S is set to $0.3<M/S<0.8$, it is also possible to achieve a further reduction in blow noise in the event of a large volume of gas entailing significant blow noise. Further, it is preferable that the rate H/L be set to $0.1<H/L<0.25$. Since the rate H/L is set to $0.1<H/L<0.25$, it is possible to reduce significantly the level of blow noise in comparison with a conventional impeller that has no notches 17, and with an impeller that has saw teeth, as described in the patent document 1 mentioned above, and as shown in FIG. 8.

Second Embodiment

Figure 9:
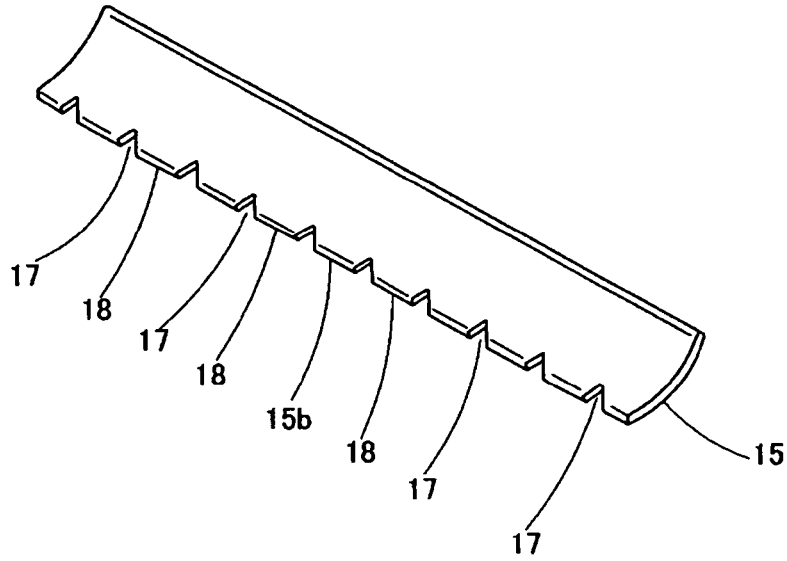
FIG. 9 is a perspective view illustrating an enlargement of a blade in accordance with a second embodiment.

FIG. 9 illustrates a blade 15 in an impeller in the shape of a cross flow fan in accordance with a second embodiment of the present invention.

As shown in FIG. 9, a plurality of regular triangular notches 17 are intermittently formed on an inner edge 15*b* of a pair of side edges of each of the blades 15 at predetermined intervals along a longitudinal direction of the blade 15. Smooth portions 18 formed along the inner edge 15*b* are arranged between the respective notches 17. In this case, in a suction region of the cross flow fan, on a trailing edge side of the blade 15, since the transverse vortex that is discharged from the inner edge 15*b* of the blade 15, and that is on a large scale is segmented into stable transverse vortexes organized on a small scale, by the vertical vortex formed in the notches 17 it is possible to reduce aerodynamic noise. Further, in the blowout region of the cross flow fan, on the basis of the vertical vortex formed by the notches 17 on the leading edge side of the blade 15 it is also possible to reduce aerodynamic noise by suppressing the peeling of the air flow on the negative pressure surface side of the blade 15. In addition, for the same reasons as mentioned above the notches 17 can be more easily formed than in the case of the conventional saw tooth shape. Further, since the smooth portions 18 constitute a part of the inner edge 15*b*, it is possible to form the notches 17 while maintaining the shape of the inner edge 15*b* of the blade 15. Further, since the shape of each of the notches 17 is formed in a regular triangular shape, it is possible to minimize areas notched by each of the notches 17 on a surface of each of the blades 15, and it is possible to secure to a maximum degree a pressure area for each of the blades 15. Since the other structures, operations and effects of the impeller 7 are the same as those described in the first embodiment, they will be omitted.

Third Embodiment

Figure 10:
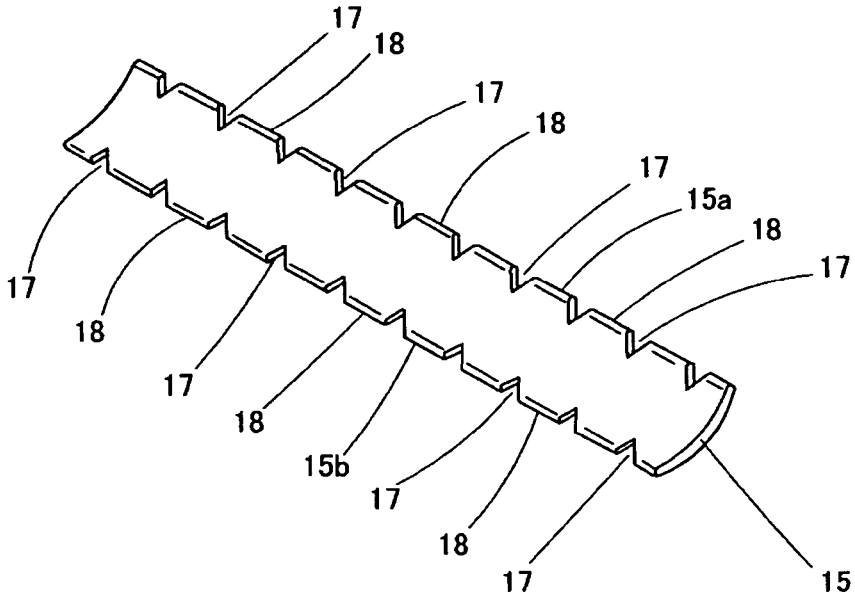
FIG. 10 is a perspective view illustrating an enlargement of a blade in accordance with a third embodiment.

FIG. 10 illustrates a blade 15 in an impeller in the shape of a cross flow fan in accordance with a third embodiment of the present invention.

As shown in FIG. 10, a plurality of regular triangular notches 17 are intermittently formed on both side edges, that is, on the outer edge 15*a* and the inner edge 15*b* of each of the blades 15 at predetermined intervals along the longitudinal direction of the blade 15. Smooth portions 18 formed along the outer edge 15*a*, or the inner edge 15*b* are arranged between the respective notches 17. In this case, in the suction region and the blowout region of the cross flow fan, on the basis of the vertical vortex formed by the notches 17 on the leading edge side of the blade 15 it is possible to reduce aerodynamic noise by suppressing the peeling of the air flow on the negative pressure surface side of the blade 15. Further, on the trailing edge side of the blade 15, since the transverse vortex that is discharged from the outer edge 15*a* or from the inner edge 15*b* of the blade 15, and that is on a large scale is segmented into stable transverse vortexes organized at the small scale, by the vertical vortex formed in the notches 17 it is possible to reduce aerodynamic noise. In addition, for the same reasons as mentioned above the notches 17 can be more easily formed than in the case of the conventional saw tooth on the basis. Further, since each of the smooth portions 18 constitutes a part of the outer edge 15*a*, or of the inner edge 15*b*, it is possible to form notches 17 while maintaining the shape of the outer edge 15*a* and the inner edge 15*b* of the blade 15. Further, since the shape of each of the notches 17 is formed as a regular triangular shape, it is possible to minimize areas notched by each of the notches 17 on the surface of each of the blades 15, and it is possible to secure to a maximum degree a pressure area of each of the blades 15. Since the other structures, operations and effects of the impeller 7 are the same as those described in the first embodiment, they will be omitted.

Figure 11:
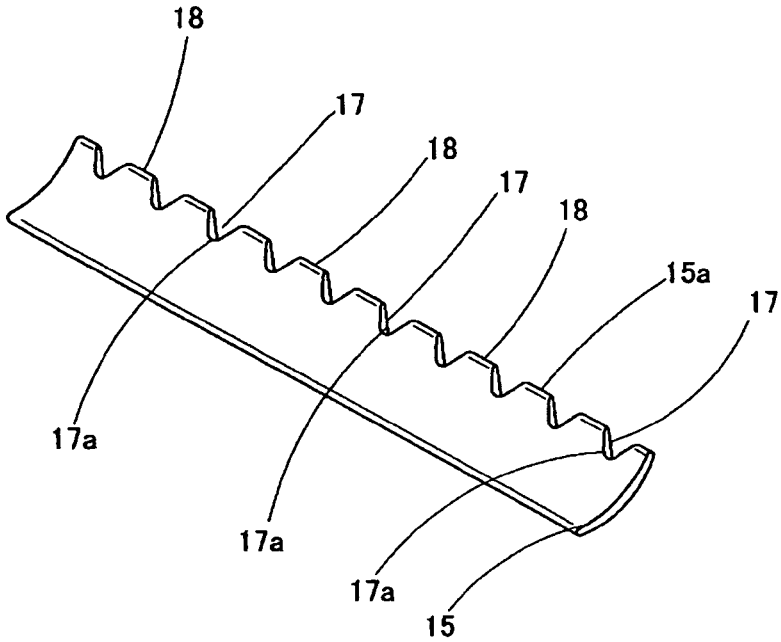
FIG. 11 is a perspective view illustrating an enlargement of a first modification of the blade in accordance with the first to third embodiments.
Figure 12:
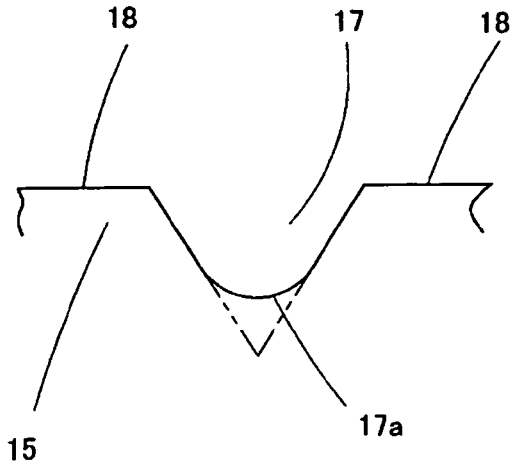
FIG. 12 is a front elevational view illustrating an enlargement of the notch in the blade shown in FIG. 11.
Figure 13:
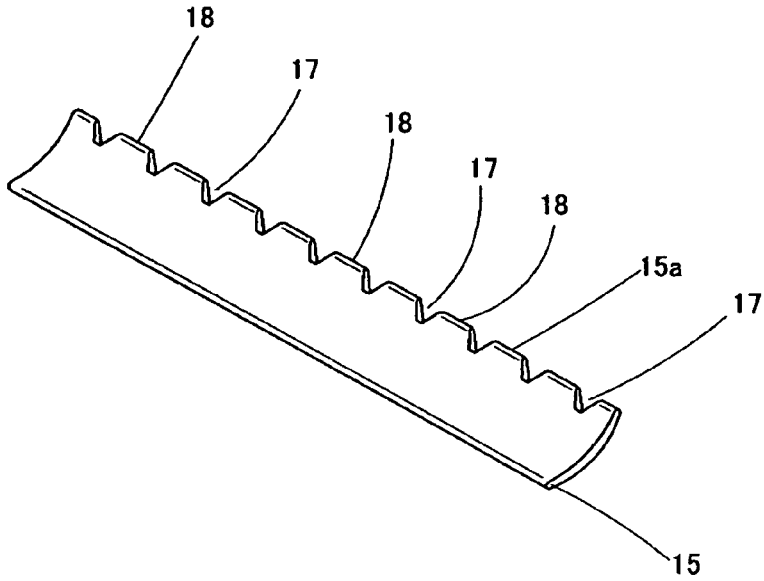
FIG. 13 is a perspective view illustrating an enlargement of a second modification of the blade in accordance with the first to third embodiments.
Figure 14:
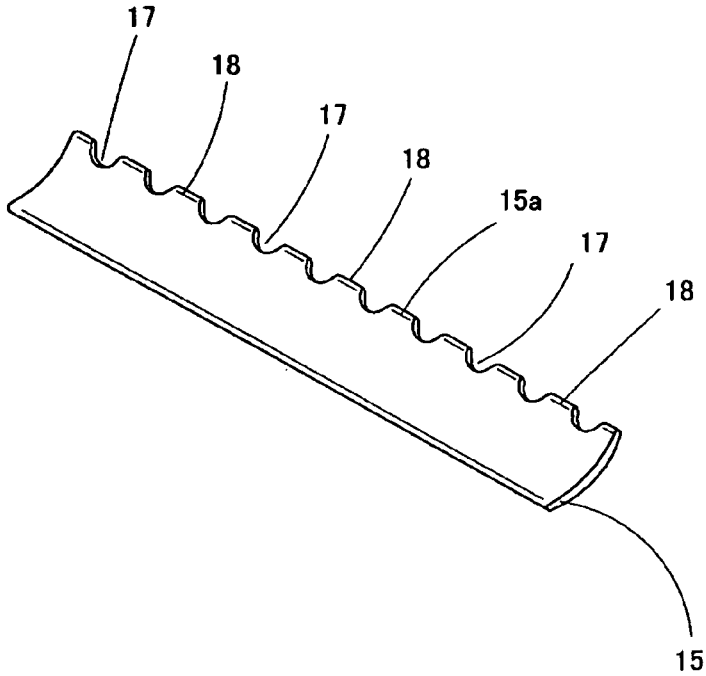
FIG. 14 is a perspective view illustrating an enlargement of a third modification of the blade in accordance with the first to third embodiments.
Figure 15:
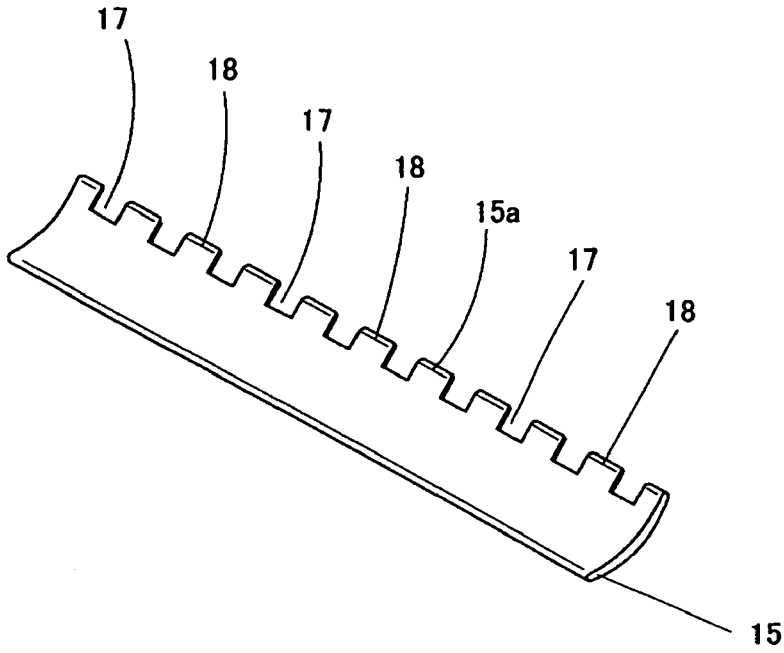
FIG. 15 is a perspective view illustrating an enlargement of a fourth modification of the blade in accordance with the first to third embodiments.

In the first to third embodiments described above, and as shown in FIGS. 11 and 12, an arcuate portion 17*a* may be formed in a bottom portion of each of the notches 17. In this case, it is difficult for breakages to occur at the bottom portion of the notches 17 at a time when a load (for example, a centrifugal force) is applied to the blade 15, and the strength of the blade 15 is improved. Further, notches 17 may be formed in triangular shapes other than the regular triangular shape, may be formed in a trapezoidal shape illustrated in FIG. 13, in an arcuate shape illustrated in FIG. 14, a rectangular shape illustrated in FIG. 15. In these cases, it is difficult for breakages to occur from the bottom portion of the notches 17 at a time when the load (for example, centrifugal force) is applied to the blade 15, and the strength of the blade 15 is enhanced.

Fourth Embodiment

Figure 16:
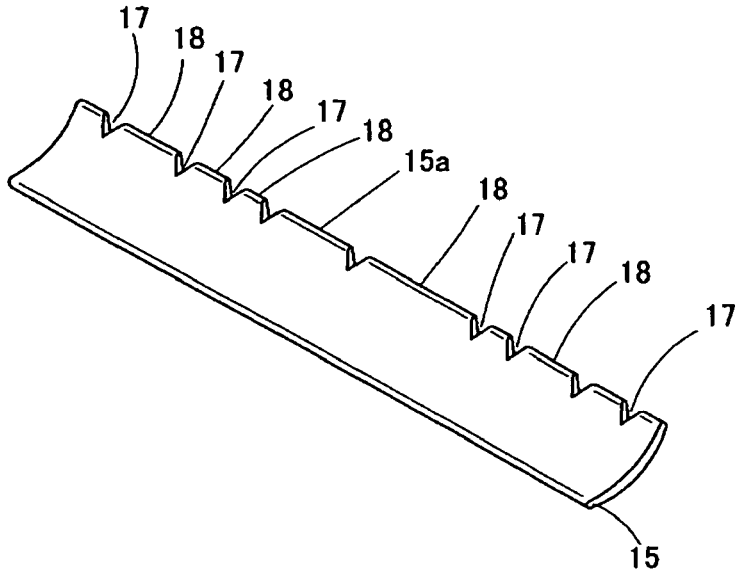
FIG. 16 is a perspective view illustrating an enlargement of a blade in accordance with a fourth embodiment.

FIG. 16 shows a blade 15 in an impeller in the shape of a cross flow fan in accordance with a fourth embodiment of the present invention.

As shown in FIG. 16, the length of each of the smooth portions 18 in each of the blade 15 (in other words, intervals between the respective notches 17) is set at random. In this case, it is possible to shift a phase of interference between the blade 15 and the other constituting members, and the air flow, and it is also possible to strengthen the effects of reducing NZ noise (blade passing frequency noise, "BPF" noise). Since the other structures, operations and effects of the impeller 7 are the same as those described in the first embodiment, they will be omitted.

Figure 17:
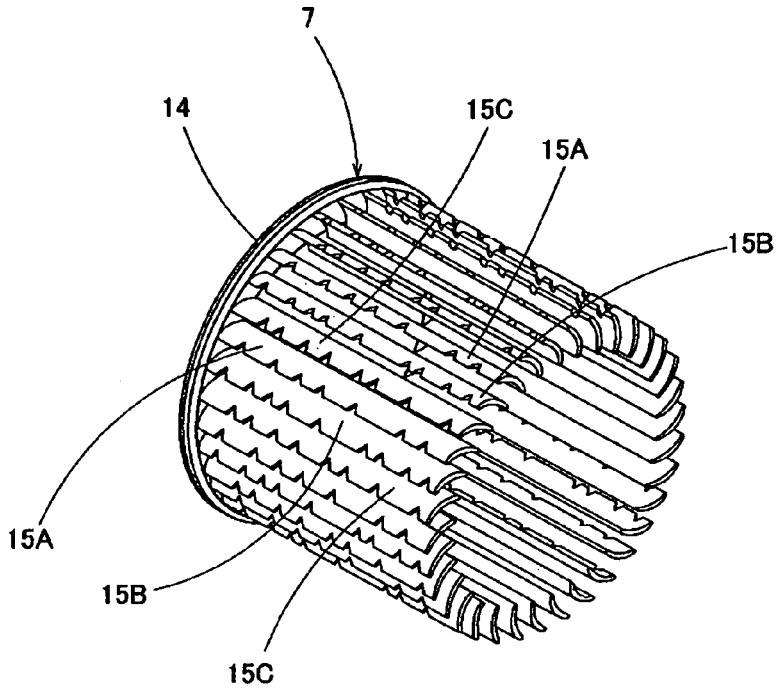
FIG. 17 is a perspective view of an impeller in accordance with the fourth embodiment.

FIG. 17 shows an example of the impeller 7 provided with the blade 15 in accordance with the present embodiment. As shown in FIG. 17, a plurality of blades 15 are provided with a plurality of blade groups configured by plural kinds of blades 15 in which the length of each of the smooth portions 18 (in other words, the intervals between the respective notches 17) are set at random. More specifically, the blade group in accordance with the present embodiment is configured by three kinds of blades 15A, 15B and 15C in which the length of each of the smooth portions 18 is set at random. In this case, it is possible to shift the phase of the interference periodically between the blade 15 and the other structures, and the air flow, and it is possible to further strengthen the effects of reducing the NZ noise (blade passing frequency noise, "BPF" noise).

Fifth Embodiment

Figure 18:
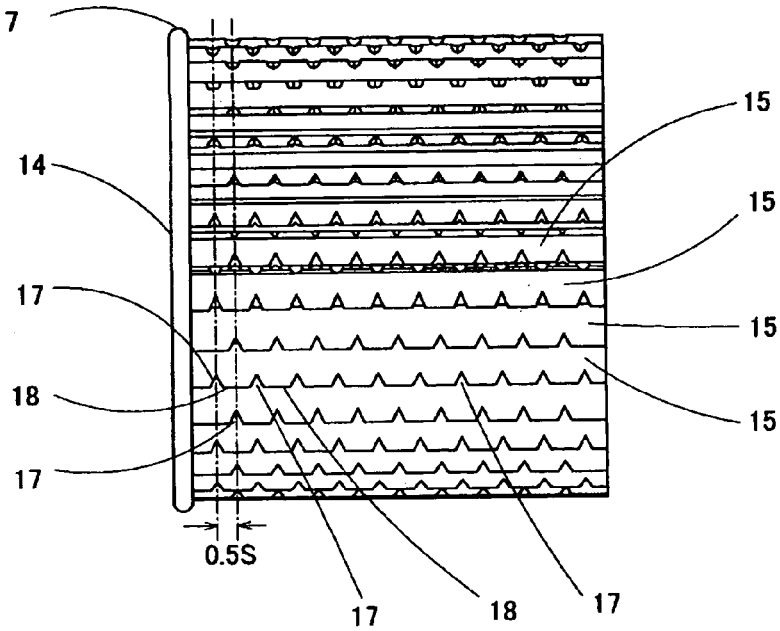
FIG. 18 is a side elevational view illustrating an impeller in accordance with a fifth embodiment.

FIG. 18 shows an impeller 7 in the form of a cross flow fan in accordance with a fifth embodiment of the present invention.

As shown in FIG. 18, the notches 17 in the adjacent blades 15 and 15 are set so as not to be positioned on a concentric circle having a center coinciding with the rotational axis of the impeller 7. In other words, intervals between the respective notches 17 of the adjacent blades 15 and 15 are set to 0.5 S, and the notches 17 are arranged in a zigzag shape. In this case, it is possible to shift the phase of the interference between the blade 15 and the other constituting members, and the air flow, it is possible to strengthen the reducing of NZ noise effects, and it is possible to prevent the strength of the blade 15 from being reduced at positions where the notches 17 are formed. Further, in case where the notches 17 are formed on the outer edge 15*a* of the blade 15, the gap between the blade 15 and the constituting member surrounding the impeller 7 becomes wider at the positions where the notches 17 are formed. Accordingly, it is possible to improve the blowing performance of the cross flow fan by preventing air flow leakages from being increased through the gap between the blade 15 and the constituting member.

In the present embodiment, the respective notches 17 are arranged in a zigzag form by setting the intervals between the respective notches 17 of the adjacent blades 15 and 15 to 0.5 S. However, the respective notches 17 may be arranged in a zigzag form by using the blade group configured by blades 15 the number of which is N, in which the intervals between the notches 17 are set to S/N (N is an integral number equal to or more than 3).

Figure 19:
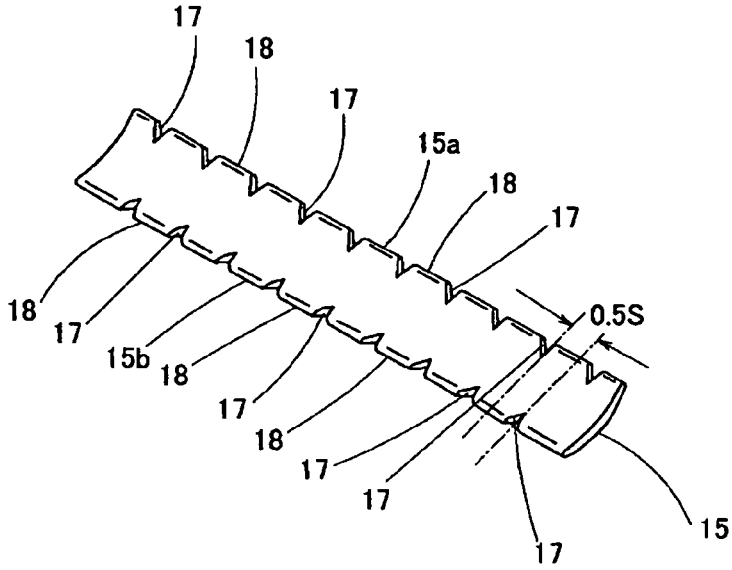
FIG. 19 is a perspective view illustrating an enlargement of a modification of a blade in accordance with the fifth embodiment.

Further, as shown in FIG. 19, in cases where the notches 17 are formed on the outer edge 15*a* and the inner edge 15*b* of the blade 15, the intervals between the notches 17 formed on the outer edge 15*a* and the notches 17 formed on the inner edge 15*b* may be set to 0.5 S. Since the other structures, operations and effects of the impeller 7 are the same as those described in the first and third embodiment, they will be omitted.

Sixth Embodiment

Figure 20:
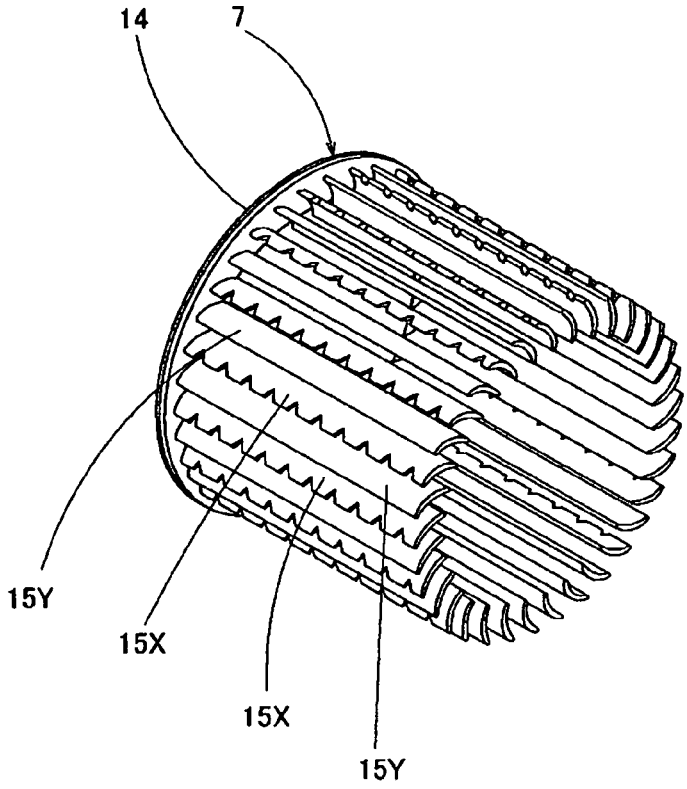
FIG. 20 is a perspective view of an impeller in accordance with a sixth embodiment.

FIG. 20 shows an impeller 7 of a cross flow fan in accordance with a sixth embodiment of the present invention.

As shown in FIG. 20, a plurality of notches 17 are intermittently formed in an outer edge 15*a* of a predetermined blade 15, that is, a blade 15X selected from a plurality of blades 15, at a predetermined interval along a longitudinal direction of the blade 15X. Each smooth portion 18 is arranged between a pair of the notches 17. In the present embodiment, the blade in which the notches 17 are formed, and a blade 15Y in which the notches 17 are not formed are alternately arranged. In this case, it is possible to improve the blowing performance of the cross flow fan by preventing a gap between the blade 15X and the member (for example, the casing) surrounding the impeller 7 from becoming wider at the position where the notches 17 are formed, thereby preventing the leak of the air flow from the gap from being increased. In addition, it is possible to improve the strength of the impeller 7 on the basis of the blade 15Y in which the notches 17 are not formed. Further, since the blade 15X in which the notches 17 are formed, and the blade 15Y in which the notches 17 are not formed are alternately arranged, the strength of the impeller 7 becomes approximately uniform in the rotating direction of the impeller 7, and a rotation balance of the impeller 7 is improved.

Figure 21:
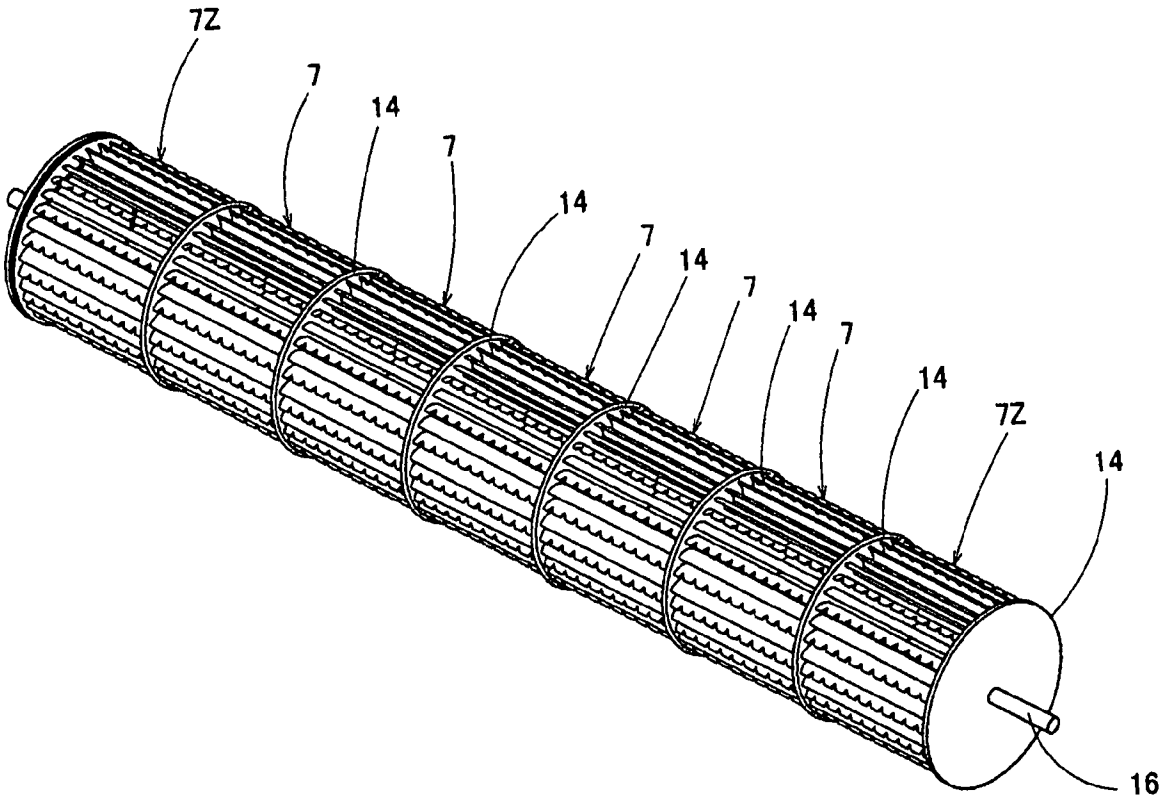
FIG. 21 is a perspective view of the impeller in accordance with the sixth embodiment.

In this case, as shown in FIG. 21, in the case of the cross flow fan provided with a plurality of impellers arranged continuously on the same rotational axis, the impellers positioned at both ends thereof may be configured by impellers 7Z and 7Z shown in FIG. 20, and the remaining impellers may be configured by the impeller 7 in which the notches 17 are formed in the outer edges 15*a* of all the blades 15. In this case, both ends of the fan are normally considered as starting point of an unstable behavior of the blowout flow at a time of a rotational destruction and a high pressure loss, however, it is possible to keep the necessary strength for the impeller while limiting a reduction of a blow noise on the basis of the suppression of generation of the trailing vortex to the minimum limit. Further, since the notches 17 are formed in the outer edge 15*a* of the blade 15, it is possible to prevent a reflow vortex formed within the impeller from being increased, and it is possible to make the unstable behavior hard to be generated at a time of the high pressure loss. The reflow vortex is formed by an increase in the leak of the air flow from the gap between the impeller and the tongue portion 11 shown in FIG. 1 at the position where the notches 17 are formed.

In this case, in the embodiment mentioned above, the notches 17 are formed in the outer edge 15*a* of the blade 15, however, the notches 17 may be formed in the inner edge 15*b* or both of the outer edge 15*a* and the inner edge 15*b*, as in the second or third embodiment. Since the other structures and operations and effects of the impellers 7 and 7Z are the same as those of the first, second or third embodiment, they will be omitted.

Seventh Embodiment

Figure 22:
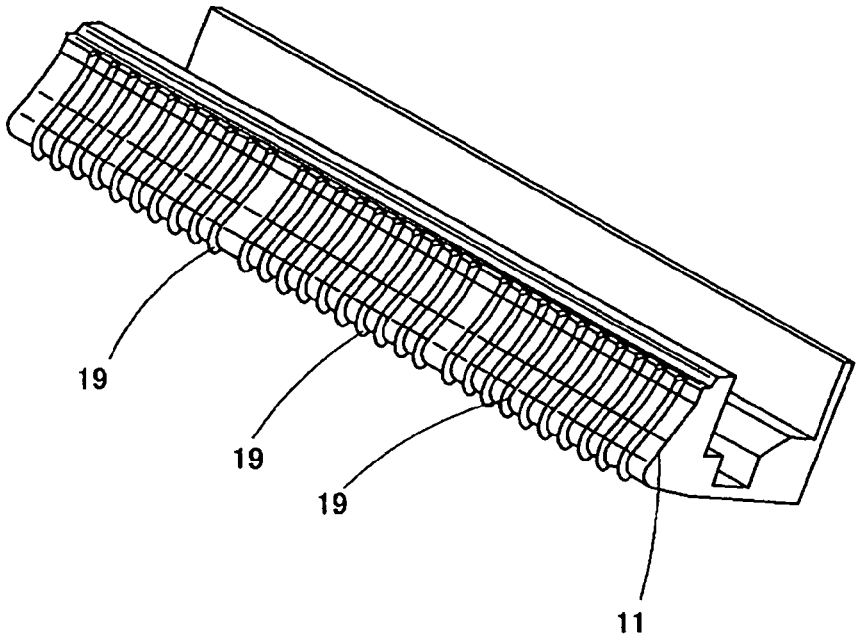
FIG. 22 is a perspective view illustrating an enlargement of a main portion of an air conditioner in accordance with a seventh embodiment.
Figure 23:
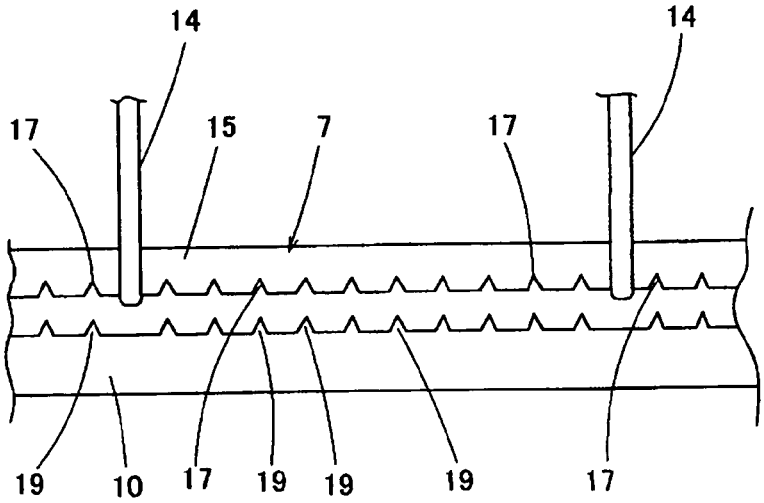
FIG. 23 is a perspective view illustrating an enlargement of the main portion of the air conditioner in accordance with the seventh embodiment.

FIGS. 22 and 23 show a main portion of a casing of an air conditioner provided with an impeller of a cross flow fan in accordance with a seventh embodiment of the present invention.

As shown in FIGS. 22 and 23, the projections 19 corresponding to the notches 17 in the outer edge 15*a* of each of the blades 15 of the impeller 7 are formed in the tongue portion 11 in the casing surrounding the impeller 7 in such a manner as to be along the rotating direction of the impeller 7. In this case, it is possible to prevent the gap between the tongue portion 11 and the impeller 7 from being expanded at the position where the notches 17 are formed, by forming the projections 19, and it is possible to prevent the air flow from leaking via the gap, whereby the blowing performance of the cross flow fan is improved. The shape and the formed positions of the notches 17 are identical in each of the blades 15.

In other words, a plurality of notches 17 having the same shape are formed on the concentric circle having the center coinciding with the rotational axis mentioned above. The sizes of the plurality of projections 19 are not limited as long as the shapes thereof are the identical. Since the structure and the operation and effect of the impeller 7 are the same as those of the first embodiment, they will be omitted.

Eighth Embodiment

Figure 24:
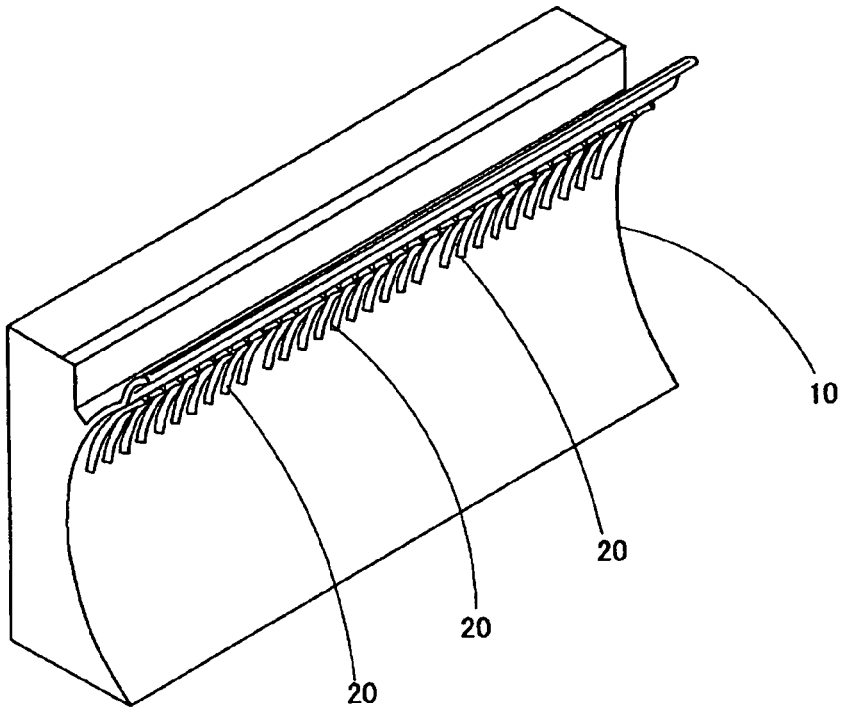
FIG. 24 is a perspective view illustrating an enlargement of a main portion of an air conditioner in accordance with an eighth embodiment.
Figure 25:
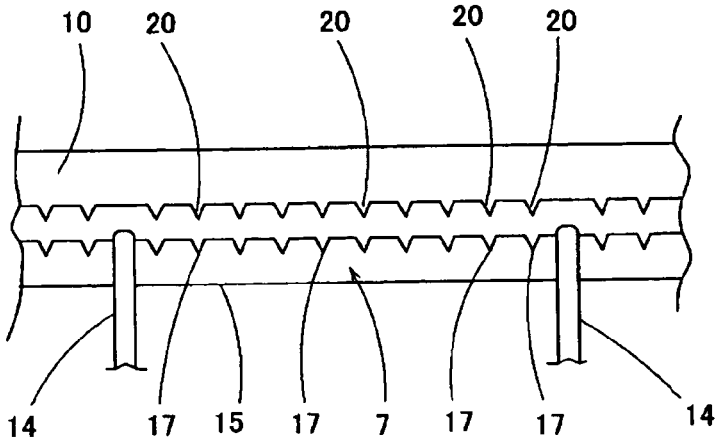
FIG. 25 is a perspective view illustrating an enlargement of the main portion of the air conditioner in accordance with the eighth embodiment.

FIGS. 24 and 25 show a main portion of a casing of an air conditioner provided with an impeller of a cross flow fan in accordance with an eighth embodiment of the present invention.

As shown in FIGS. 24 and 25, the projections 20 corresponding to the notches 17 on the outer edge 15*a* of each of the blades 15 of the impeller 7 are formed in the guide portion 10 in the casing surrounding the impeller 7 in such a manner as to be along the rotational direction of the impeller 7. In this case, by forming the projections 20 it is possible to prevent the gap between the guide portion 10 and the impeller 7 from expanding at positions where the notches 17 are formed, and it is possible to prevent the air flow from leaking through the gap. The air flow performance of the cross flow fan thereby can be enhanced. The shape and the positions of the notches 17 are identical in each of the blades 15. In other words, a plurality of notches 17 having the same shape are formed on a concentric circle having a center coinciding with the rotational axis mentioned above. The sizes of the plurality of projections 20 are not limited as long as the shapes thereof are identical. Since the structure, the operation and effects of the impeller 7 are the same as those described in the first embodiment, they will be omitted.

The blade 15 in accordance with the first to eighth embodiments may be used as a blade for a sirocco fan or a turbo fan. Further, in the same manner as described in the first to third embodiments described above each of the notches 17 in accordance with the fourth to eighth embodiments may be formed in a triangular shape other than a regular triangular shape; in a triangular shape having an arcuate portion in a bottom portion; in a trapezoidal shape; in an arcuate shape; or in a rectangular shape. In this case, it is difficult for the destruction to occur from the bottom portion of the notches 17 at a time when a load (for example, a centrifugal force) is applied to the blade 15, and the strength of the blade 15 is thereby enhanced.

The invention claimed is:

1. An impeller for a blower having: a circular support plate having a rotational axis; and a plurality of blades provided on a peripheral edge portion of the support plate, extending in parallel to the rotational axis and having a predetermined blade angle, the impeller comprising:

a plurality of notches provided on an outer edge of a pair of side edges of each of the blades, and arranged at predetermined intervals along a longitudinal direction of the respective blades; and a plurality of smooth portions, each being provided between a pair of the notches, wherein the notches have a triangular shape and an arcuate portion is formed in a bottom portion of each of the notches, wherein in a case where a pitch of the notches is denoted as S, and a length of each of smooth portions is denoted as M, a rate M/S of the length M of the smooth portions to the pitch S of the notches is set to $0.3<M/S<0.8$.

2. The impeller for a blower according to claim 1, wherein in a case where a chord length of each of the blades is denoted as L, and a depth of each of the notches is denoted as H, a rate H/L of the depth H of the notches to the chord length L of the blades is set to $0.1<H/L<0.25$.

3. The impeller for a blower according to claim 1, wherein the shapes of the plurality of notches are identical, and the length of the respective smooth portions are set at random.

4. The impeller for a blower according to claim 1, wherein the respective notches in the adjacent blades are set such as not to be positioned on a concentric circle having a center coinciding with the rotational axis.

5. An impeller for a blower according to claim 1, further comprising a rotation shaft arranged on the rotational axis.

6. An air conditioner comprising the impeller for the blower according to claim 1.

7. An air conditioner comprising: the impeller for the blower according to claim 1; and a casing that surrounds the impeller and has a tongue portion preventing a back flow of air flow blowing out of the impeller, wherein a plurality of notches having an identical shape are formed coaxially on an outer edge of each of the blades, and wherein a plurality of projections are provided on the tongue portion, and the respective projections correspond to the respective notches provided on the outer edge.

8. An air conditioner comprising: the impeller for the blower according to claim 1; and a casing that surrounds the impeller and has a guide portion for guiding an air flow blowing out of the impeller, wherein a plurality of notches having an identical shape are formed coaxially on an outer edge of each of the blades, and wherein a plurality of projections are provided on the guide portion, and the respective projections correspond to the respective notches provided on the outer edge.

9. An impeller for a blower having: a circular support plate having a rotational axis; and a plurality of blades provided on a peripheral edge portion of the support plate, extending in parallel to the rotational axis and having a predetermined blade angle, the impeller comprising:

a plurality of notches provided on an outer edge of a pair of side edges of a predetermined blade selected from among the plurality of blades, arranged at predetermined intervals along a longitudinal direction of the predetermined blade; and a plurality of smooth portions, each being provided between a pair of the notches, wherein the notches have a triangular shape, and an arcuate portion is formed in a bottom portion of each of the notches, wherein in a case where a pitch of the notches is denoted as S, and a length of each of smooth portions is denoted as M, a rate M/S of the length M of the smooth portions to the pitch S of the notches is set to $0.3<M/S<0.8$.

10. An impeller for a blower according to claim 9, wherein the plurality of blades include a blade in which the notches are provided, and a blade in which the notches are not provided, and wherein the blade in which the notches are provided and the blade in which the notch are not provided are alternately arranged.

11. An impeller for a blower comprising a plurality of impellers continuously provided on the same rotational axis, wherein in the plurality of impellers, the impellers positioned at both ends of the blower are formed by the impeller for the blower according to claim 9, and the other impellers are formed by the impeller having: a circular support plate having a rotational axis; and a plurality of blades provided on a peripheral edge portion of the support plate, extending in parallel to the rotational axis and having a predetermined blade angle, the impeller comprising:

a plurality of notches provided on an outer edge of a pair of side edges of each of the blades, and arranged at predetermined intervals along a longitudinal direction of the respective blades; and a plurality of smooth portions, each being provided between a pair of the notches, wherein the notches have a triangular shape, and an arcuate portion is formed in a bottom portion of each of the notches, wherein in a case where a pitch of the notches is denoted as S, and a length of each of smooth portions is denoted as M, a rate M/S of the length M of the smooth portions to the pitch S of the notches is set to $0.3<M/S<0.8$.

* * * * *